US006733314B2

(12) United States Patent
Konda

(10) Patent No.: US 6,733,314 B2
(45) Date of Patent: May 11, 2004

(54) CONNECTOR APPARATUS

(75) Inventor: Kazumoto Konda, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/442,207

(22) Filed: May 21, 2003

(65) Prior Publication Data

US 2004/0002240 A1 Jan. 1, 2004

(30) Foreign Application Priority Data

Jun. 28, 2002 (JP) ..... 2002-190081

(51) Int. Cl.[7] ..... H01R 13/62
(52) U.S. Cl. ..... 439/157; 439/347
(58) Field of Search ..... 439/157, 310, 439/347

(56) References Cited

U.S. PATENT DOCUMENTS 4,586,771 A 5/1986 Kraemer et al. ..... 439/325
5,478,251 A * 12/1995 Jaklin ..... 439/157
6,036,509 A * 3/2000 Maejima ..... 439/157
6,244,880 B1 * 6/2001 Fukase et al. ..... 439/157
6,254,407 B1 * 7/2001 Burns ..... 439/157

* cited by examiner

*Primary Examiner*—Renee Luebke
*Assistant Examiner*—Ann McCamey
(74) *Attorney, Agent, or Firm*—Oliff & Berridge, PLC

(57) ABSTRACT

In fitting a movable-side housing on a stationary-side housing, a front leading end portion of the movable-side housing is brought into contact with a front base portion of the stationary-side housing. At this time, it is unnecessary to accurately place the movable-side housing in position. When the movable-side housing is moved toward a matching position, guides guide the movable-side housing to the matching position reliably. Consequently, the cam followers fit into entrances of cam grooves. Thereafter, a slide lever is moved to bring electrodes of one housing into connection with electrodes of the other housing. It is not difficult to properly position the movable-side housing with respect to the stationary-side housing. Therefore, even in a situation in which it is difficult to visually check the position of the movable-side housing, an operation of fitting the movable-side housing on the stationary-side housing can be performed easily and reliably.

5 Claims, 6 Drawing Sheets

CONNECTOR APPARATUS

BACKGROUND OF THE INVENTION

1. Field of Invention

The present invention relates to a connector apparatus, such as a breaker apparatus.

2. Description of Related Art

In a known breaker apparatus, a stationary-side housing is provided with a pair of stationary electrodes, a movable-side housing is provided with a movable electrode for short-circuiting a pair of the stationary electrodes, and the movable-side housing is provided with a slide lever having a cam groove. In fitting the movable-side housing on the stationary-side housing, a cam follower of the stationary-side housing is fitted in an entrance of the cam groove by fitting the movable-side housing on the stationary-side housing shallowly, with the slide lever disposed at an initial position. When the slide lever is subsequently moved to a lock position, the movable-side housing is moved toward the stationary-side housing owing to a cam operation caused by engagement between the cam groove and the cam follower. Consequently the movable-side housing fits on the stationary-side housing, and the movable electrode contacts the stationary electrodes. Thereby the stationary electrodes are short-circuited.

Japanese Patent Laid-Open Application No. 6-52929 disclose an example of such a breaker apparatus in which both housings are fitted on each other owing to a cam operation that is performed by the use of a slide lever.

SUMMARY OF THE INVENTION

In the above-described conventional breaker apparatus, in fitting the entrance of the cam groove on the cam follower, it is necessary to position the movable-side housing with respect to the stationary-side housing. However, the cam groove is comparatively narrow, and the cam follower has a small diameter. Thus, it is difficult to perform the operation of positioning the movable-side housing with respect to the stationary-side housing.

In a situation in which the position of the housing cannot be checked visually and thus it is necessary to perform a positioning operation gropingly, i.e., "by feel," it is very difficult to do so.

The present invention has been made in view of the above-described situation. Accordingly, it is an object of the present invention to fit a movable-side housing on a stationary-side housing easily.

In the present invention, there is provided a connector apparatus, such as a breaker apparatus, including a stationary-side housing having at least one cam follower on an outer side surface; at least one stationary electrode provided on the stationary-side housing; a movable-side housing including a fit-on portion and fitted on the stationary-side housing in such a way that the stationary-side housing is covered with the fit-on portion of the movable-side housing in a direction from a front side of the stationary-side housing; at least one moveable electrode provided on the movable-side housing; and a slide lever capable of moving linearly between an initial position and a fit-on position along an inner surface of a side wall of the fit-on portion in a direction substantially orthogonal to a direction in which the movable-side housing fits on the stationary-side housing.

In this construction, the at least one stationary electrode and the at least one movable electrode are connected to each other, with the fit-on portion being fitted on the stationary-side housing in association with a cam operation performed by cooperation of a cam groove of the slide lever and the cam follower of the stationary-side housing, by moving the cam follower into an entrance of the cam groove when the slide lever is disposed at the initial position and then moving the slide lever to the fit-on position.

The connector apparatus further includes a plurality of guides provided on an outer side surface of the stationary-side housing and the inner surface of the side wall of the fit-on portion. The guides do not engage each other at an unmatching position where a front leading end portion of the movable-side housing contacts a front base portion of the stationary-side housing and at a matching position where the front leading end portion of the movable-side housing matches a front leading end portion of the stationary-side housing to match the entrance of the cam groove with the cam follower. The guides engage each other during movement of the movable-side housing from the unmatching position to the matching position to thereby guide the movable-side housing.

The guides may have a leading portion that guides the cam follower into the entrance of said the cam groove and guides the movable-side housing in an oblique direction with respect to the direction of movement of the slide lever during movement of the second housing from a position before the matching position to the matching position.

The connector apparatus may further include a leading surface formed on a front edge of a lower end of the stationary-side housing, and the leading surface may assist the leading portion in guiding the movable-side housing in an oblique direction with respect to the direction of movement of said slide lever during the movement of said second housing from a position before the matching position to the matching position. The leading surface may be provided at a position spaced from the leading portion in a direction in which the movable-side housing moves between the unmatching position and the matching position.

The direction of movement of the movable-side housing as it moves from the unmatching position to the matching position may be the same as the direction of movement of the slide lever as it moves from the initial position to the fit-on position.

In fitting the movable-side housing on the stationary-side housing, with the slide lever disposed at the initial position, the front leading end portion of the movable-side housing is brought into contact with the front base portion of the stationary-side housing to place the movable-side housing at the unmatching position. When the movable-side housing is brought into contact with the stationary-side housing, the guides do not engage each other. Thus, there is no interference in the operation of bringing the movable-side housing into contact with the stationary-side housing. Further, because it is unnecessary to match the entrance of the cam groove with the cam follower, it is not difficult to place the housings in their proper relative position.

As the movable-side housing is moved from the unmatching position toward the matching position, the guides engage each other and perform their guiding function. Owing to the function of the guides, the movable-side housing moves to the matching position reliably and allows the entrance of the cam groove to match the cam follower. Thereafter, the slide lever is moved from the initial position to the fit-on position, with the cam follower and the entrance of the cam groove engaging with each other.

As is apparent from the foregoing description, it is not difficult to place the housings in the proper relative position.

Therefore, even in a situation in which it is difficult to visually check the position of the movable-side housing and hence it is necessary to perform a positioning operation gropingly, the movable-side housing can be fitted to the stationary-side housing easily and reliably.

In the stage in which the movable-side housing moves from the position before the matching position to the matching position, the moving direction of the movable-side housing is altered to an oblique direction by the guidance of the leading portion and/or the leading surface. As this movement progresses, the cam follower fits into the entrance of the cam groove. Thus, it is possible to accomplish the operation of moving the movable-side housing to the matching position and the operation of fitting the cam follower into the entrance of the cam groove by one action.

Therefore, the operation to be performed according to the construction of the present invention has higher workability than an operation of moving the movable-side housing to the matching position and then fitting the cam groove onto the cam follower by shifting the movable-side housing from an operator's one hand to the other.

In changing the moving direction of the movable-side housing by the guiding of the leading portion and the leading surface, the movable-side housing is guided at upper and lower positions. Thus, the movable-side housing is kept in a predetermined posture. Thereby, it is possible to reliably fit the entrance of the cam groove onto the cam follower.

The direction of the movable-side housing in fitting the movable-side housing on the stationary-side housing may be the same as the direction of the slide lever that moves after the movement of the movable-side housing terminates. This enhances workability.

BRIEF DESCRIPTION OF THE DRAWINGS

Exemplary embodiments of this invention will be described in detail, with reference to the following drawings, wherein.

DETAILED DESCRIPTION OF PREFERRED EMBODIMENTS

Figure 1:
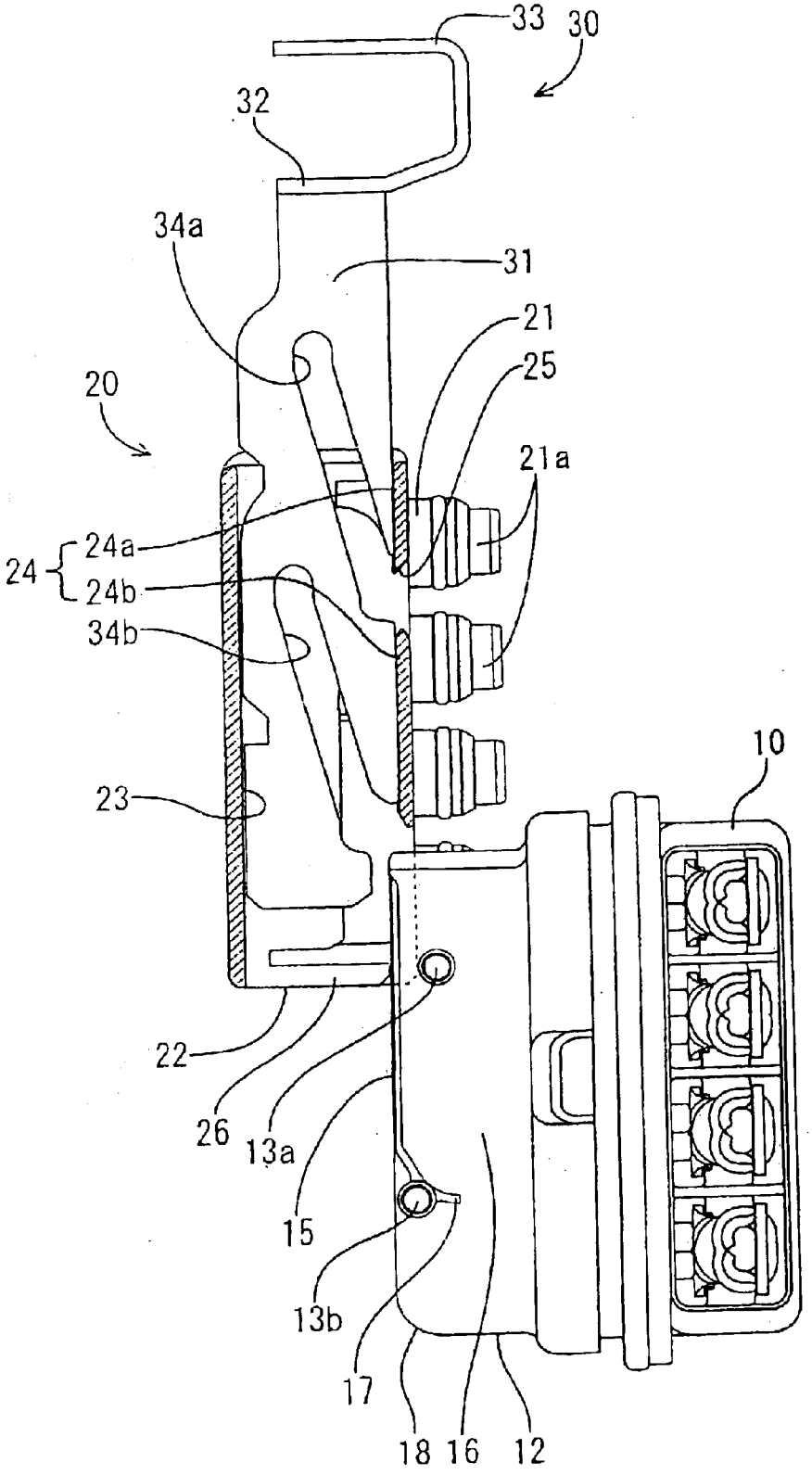
FIG. 1 is a partly cut away side view of an embodiment showing a state in which a front leading end portion of a movable-side housing is in contact with a front base portion of a stationary-side housing.

An exemplary embodiment of the present invention will be described below with reference to FIGS. 1 through 6. In the following embodiment, a breaker apparatus is described as an example of a connector apparatus. However, it will be appreciated that the connector apparatus according to the invention are not limited to breaker apparatus.

In a breaker apparatus of the embodiment, stationary electrodes 11 (see FIG. 4) provided in series with a main circuit (not shown) are mounted on a stationary-side housing 10. Movable electrodes 21 installed on the movable-side housing 20 are matable with the stationary electrodes 11. In a mated state of the movable electrodes 21 and the stationary electrodes 11, electricity is allowed to flow between predetermined ones of the stationary electrodes 11. In an unmated state of the movable electrodes 21 and the stationary electrodes 11, electricity is restricted from flowing between the predetermined ones of the stationary electrodes 11.

The stationary-side housing 10 may be rectangular as a whole. The stationary-side housing 10 may be fixedly installed in a comparatively small space, such as an engine compartment of a vehicle. Two pairs of stationary electrodes 11 are vertically arranged at the front side of the stationary-side housing 10 (left-hand side of the stationary-side housing 10 in FIGS. 1–4, namely, the side of the stationary-side housing 10 facing the movable-side housing 20).

The movable-side housing 20 can be selectively fitted on or separated from the stationary-side housing 10. The movable-side housing 20 may be rectangular as a whole. Two pairs of movable electrodes 21 may be arranged at the front side of the movable-side housing 20 (right-hand side of the movable-side housing 20 in FIGS. 1–4, namely, the side of the movable-side housing 20 facing the stationary-side housing 10). Each movable electrode 21 has two open cylindrical (or other-shaped) portions 21*a* arranged at the front side thereof. The cylindrical portions 21*a* project from the front surface of the movable-side housing 20. When stationary and movable-side housings 10 and 20 fit together, the two cylindrical portions 21 a of each movable electrode 21 fit on a pair of the stationary electrodes 11 to allow the stationary electrodes 11 to be in an electrically short-circuit state (electric conductivity-permitted state). Electrical conductivity among the stationary electrodes 11 is terminated by separating the movable electrodes 21 from the stationary electrodes 11.

A hood part 12 open at its upper side (top side in FIGS. 1–4) and front side (left-hand side in FIGS. 1–4) and approximately U-shaped in a front view projects toward the front side. In correspondence to the hood part 12, a fit-on portion 22 to be fitted on the periphery of the hood part 12 is formed on the movable-side housing 20. When the movable-side housing 20 moves in a longitudinal direction (a direction parallel to the direction in which the movable electrodes 21 engage the stationary electrodes 11) and fits on the stationary-side housing 10, with the front side of the movable-side housing 20 matching that of the stationary-side housing 10 (positional relationship in which the movable electrodes 21 match the stationary electrodes 11), free movement of the stationary and movable-side housings 10 and 20 in lateral directions (directions orthogonal to the direction in which the movable electrodes 21 engage the stationary electrodes 11) is restricted, because the hood part 12 fits on an inner peripheral edge of the fit-on portion 22. A pair of cam followers 13*a* and 13*b* projects from an outer side surface of the hood part 12 of the stationary-side housing 10 respectively (see also FIG. 5), and a corresponding pair of cam followers 13*a* and 13*b* projects from an opposite outer side surface of the hood part 12. Each of the cam followers 13*a* and 13*b* is preferably cylindrical. Metal rings 14*a* and 14*b* may be included on the cam followers 13*a* and 13*b*, and are preferably each rotatably mounted on the peripheral surface of a respective one of the cam followers 13*a* and 13*b*.

Right and left guide portions 23 are formed on an inner surface of right and left side walls of the fit-on portion 22.

Figure 5:
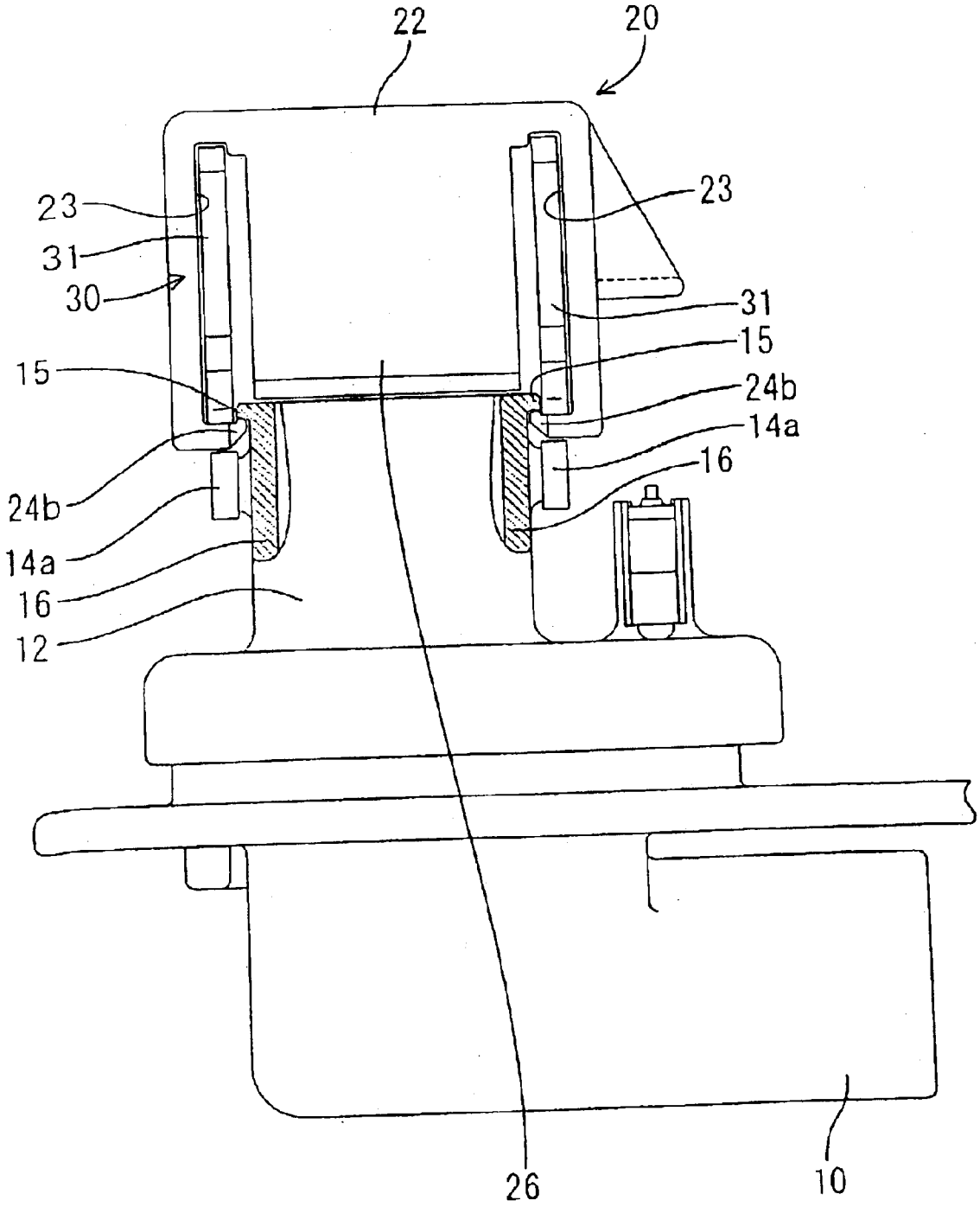
FIG. 5 is a bottom view showing a state in which the movable-side housing is at the unmatching position.
Figure 6:
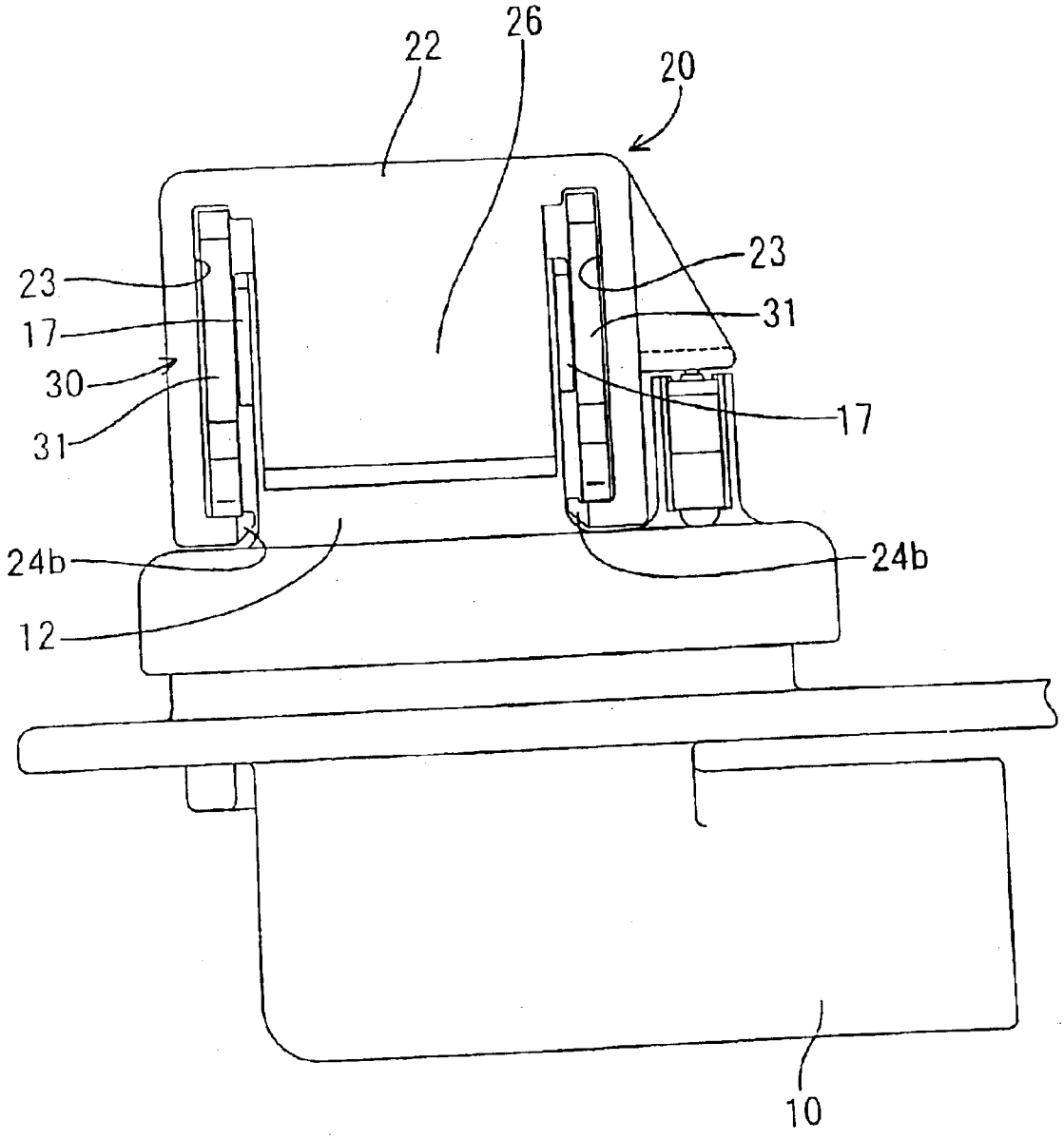
FIG. 6 is a bottom view showing a state in which both housings have fitted on each other.

As shown in FIG. 5, slits are provided in upper and lower walls of the fit-on portion 22, in alignment with the guide portions 23, to allow cam plates 31 of a slide lever 30 to pass into the guide portions 23.

The slide lever 30 may be formed by press-working of a steel plate, or by any other desired process and/or material. The slide lever 30 includes the plate-shaped cam plates 31, a connection plate 32 connecting the upper ends of the cam plates 31 to each other, and an operation portion 33, approximately L-shaped in a side view, extended upward from the connection plate 32. The slide lever 30 is installed on the movable-side housing 20, with the connection plate 32 and the operation portion 33 of the slide lever 30 disposed above the movable-side housing 20 (such as above the fit-on portion 22) and exposed to the outside and with the cam plates 31 fitted in the guide portions 23 respectively. By being guided by the guide portions 23, the slide lever 30 is movable in a vertical direction (a direction orthogonal to the direction in which the movable electrodes 21 engage the stationary electrodes 11 and separate therefrom) between a fit-on position and an initial position disposed above the fit-on position.

Upper and lower cam grooves 34*a* and 34*b* are formed on the cam plates 31 respectively. The entrance of each cam groove 34*a* and 34*b* is open at a front edge of the cam plate 31 facing the stationary-side housing 10. The cam grooves 34*a* and 34*b* extend obliquely to both the movement direction of the slide lever 30 and the direction in which the movable electrodes 21 engage the stationary electrodes 11 and separate therefrom. When both housings 11 and 21 are positioned in a corresponding position (i.e., the movable-side housing 20 and the stationary-side housing 10 are at the matching position) and when the slide lever 30 is at the initial position, the cam followers 13*a* and 13*b* are capable of penetrating into the entrance of the cam groove 34*a* and that of the cam groove 34*b* respectively. When the slide lever 30 moves downward in FIGS. 1–4 in the state in which the cam followers 13*a* and 13*b* have entered the entrance of the cam groove 34*a* and that of the cam groove 34*b* respectively, the movable-side housing 20 is moved toward the stationary-side housing 10 owing to a cam operation caused by the engagement between the cam groove 34*a* and the cam follower 13*a* and between the cam groove 34*b* and the cam follower 13*b*. When the slide lever 30 has reached a fit-on position, the movable-side housing 20 fits on the stationary-side housing 10 completely. At the same time, the connection between the movable electrodes 21 and the stationary electrodes 11 is completed.

When the slide lever 30 is lifted upward while in the fit-on state, the movable-side housing 20 separates from the stationary-side housing 10, and the movable electrodes 21 separate from the stationary electrodes 11 owing to the cam operation caused by the engagement between the cam groove 34*a* and the cam follower 13*a* and between the cam groove 34*b* and the cam follower 13*b*.

Along the front edge of the right and left outer side surfaces of the hood part 12, a pair of stationary-side guide ribs 15 extending vertically is formed on the hood part 12 of the stationary-side housing 10. Each of the stationary-side guide ribs 15 extends from the upper end of the hood part 12, past the cam follower 13*a*, to a position a little above the cam follower 13*b*. The cam followers 13*a* and 13*b* project outward, beyond the stationary-side guide ribs 15, from the right and left outer side surfaces of the hood part 12 respectively (see FIG. 5).

A movable-side guide rib 24, having an upper portion 24*a* and a lower portion 24*b* and extending vertically, is formed on the fit-on portion 22 of the stationary-side housing 10 along the front edge of an inner surface of each of the right and left outer side walls of the fit-on portion 22. When the movable-side guide ribs 24 are locked to the stationary-side guide ribs 15 respectively, separation of the movable-side housing 20 from the stationary-side housing 10 is restricted. The upper portion 24*a* of each movable-side guide rib 24 is formed in a region from the upper end of the fit-on portion 22 to the entrance of the upper cam groove 34*a*, as viewed when the slide lever 30 is at the initial position. The lower portion 24*b* of the movable-side guide rib 24 is formed in a region from the entrance of the upper cam groove 34*a* to the entrance of the lower cam groove 34*b*, as viewed when the slide lever 30 is at the initial position. Therefore, a cut-out portion 25 corresponding to the entrance of the upper cam groove 34*a*, as viewed when the slide lever 30 is at the initial position, is formed between the upper portion 24*a* and the lower portion 24*b* of the movable-side guide rib 24.

The movable-side guide rib 24 is not formed in a region from the lower end of the lower portion 24*b* of the movable-side guide rib 24 to the lower end (leading end of the present invention) of the fit-on portion 22. In the region in which the movable-side guide rib 24 is not formed, the entrance of the lower cam groove 34*b* is not closed by the upper portion 24*a* or the lower portion 24*b* when the slide lever 30 is at the initial position. Thus, the cam follower 13*b* is permitted to penetrate into the entrance of the lower cam groove 34*b*. When the region in which the movable-side guide rib is not formed, namely, the lower end of the fit-on portion 22, approaches the upper front end of the stationary-side housing 10 from the front of the stationary-side housing 10 (e.g., as shown in FIG. 1), the upper end of the stationary-side guide rib 15 is fitted into the fit-on portion 22, and right and left ends of the fit-on portion 22 at the front end of a lower-surface wall 26 (front leading end portion of the movable-side housing 20) thereof contacts the upper front end of the right and left side walls 16 of the hood part 12 (see FIGS. 1 and 5). The state shown in FIG. 1 is called an unmatching state, and in this state the position of the movable-side housing 20 is unmatching with respect to that of the stationary-side housing 10. A guide structure is constituted of the front end of the lower-surface wall 26 of the fit-on portion 22 and the front end of the right and left side walls 16 of the hood part 12. When the lower-surface wall 26 of the fit-on portion 22 is brought into contact with the side wall 16 of the hood part 12, the upper portions 24*a* and the lower portions 24*b* of the movable-side guide ribs 24 are in a lockable positional relationship with the stationary-side guide ribs 15 in a longitudinal direction (a direction parallel to the direction in which the movable electrodes 21 engage the stationary electrodes 11).

Leading ribs 17, preferably having an arcuate shape, are formed on the right and left outer side surfaces of the hood part 12. Each leading rib 17 extends approximately obliquely, downwardly, and away from the lower end of the corresponding stationary-side guide rib 15. Each leading rib 17 is positioned along the upper rear side (upper right side in FIG. 1) of the corresponding lower cam follower 13*b*. A leading surface 18, preferably also having an arcuate shape, is formed from the front edge of the lower end of the hood part 12 to the lower surface thereof. An interval is provided between the leading rib 17 and the leading surface 18 in the same direction as the direction in which the movable-side housing 20 moves between the matching position and the unmatching position.

The operation of the above-described exemplary embodiment will be described below.

In fitting the movable-side housing 20 on the stationary-side housing 10, the movable-side housing 20 is caused to approach the stationary-side housing 10, with the slide lever 30 disposed at the initial position and with the movable-side housing 20 disposed at a position shifted upward from the stationary-side housing 10 (see FIG. 1). In this state, the front end of the lower-surface wall 26 of the fit-on portion 22 is brought into contact with the front base portion of the hood part 12 to place the movable-side housing 20 at an unmatching position. When the movable-side housing 20 is brought into initial contact with the stationary-side housing 10, the upper portions 24*a* and the lower portions 24*b* of the guide ribs 24 do not interfere with the stationary-side guide ribs 15. Thus, there is no interference in the operation of bringing the movable-side housing 20 into contact with the stationary-side housing 10. Because it is unnecessary at this stage to match the entrances of the cam grooves 34*a* and 34*b* with the cam followers 13*a* and 13*b* respectively, the movable-side housing 20 is permitted to vertically shift a little from the matching position. Therefore, it is unnecessary to accurately position the movable-side housing 20 in bringing the movable-side housing 20 into contact with the stationary-side housing 10. Because the upper end of the hood part 12 enters the fit-on portion 22 when the movable-side housing 20 is at the unmatching position, the movable-side housing 20 is restricted from freely shifting greatly from the stationary-side housing 10 in a lateral direction (a direction orthogonal to the plane of the paper in FIGS. 1–4).

Immediately after the movable-side housing 20 at the unmatching position is moved toward the matching position, with the movable-side housing 20 being pressed against the hood part 12, the lower end of the lower portion 24*b* starts to be locked to the upper end of the stationary-side guide rib 15. As the movement of the movable-side housing 20 progresses, the locking area of the upper portion 24*a* and the lower portion 24*b* and that of the stationary-side guide rib 15 increase in the longitudinal direction. The guide structure performs its guiding function in conjunction with this locking. Thus, the movable-side housing 20 moves to the matching position reliably without freely moving in a longitudinal direction (a direction parallel to the direction in which the movable electrodes 21 engage the stationary electrodes 11) with respect to the stationary-side housing 10. During this period of time, the movable-side housing 20 is restricted from freely moving in the longitudinal direction with respect to the stationary-side housing 10, and the posture of the movable-side housing 20 is prevented from inclining forward or rearward. This is because the upper portions 24*a* and the lower portions 24*b* of the guide ribs 24 are locked to the stationary-side guide ribs 15, and the lower-surface wall 26 of the fit-on portion 22 contacts the side walls 16 of the hood part 12.

Figure 2:
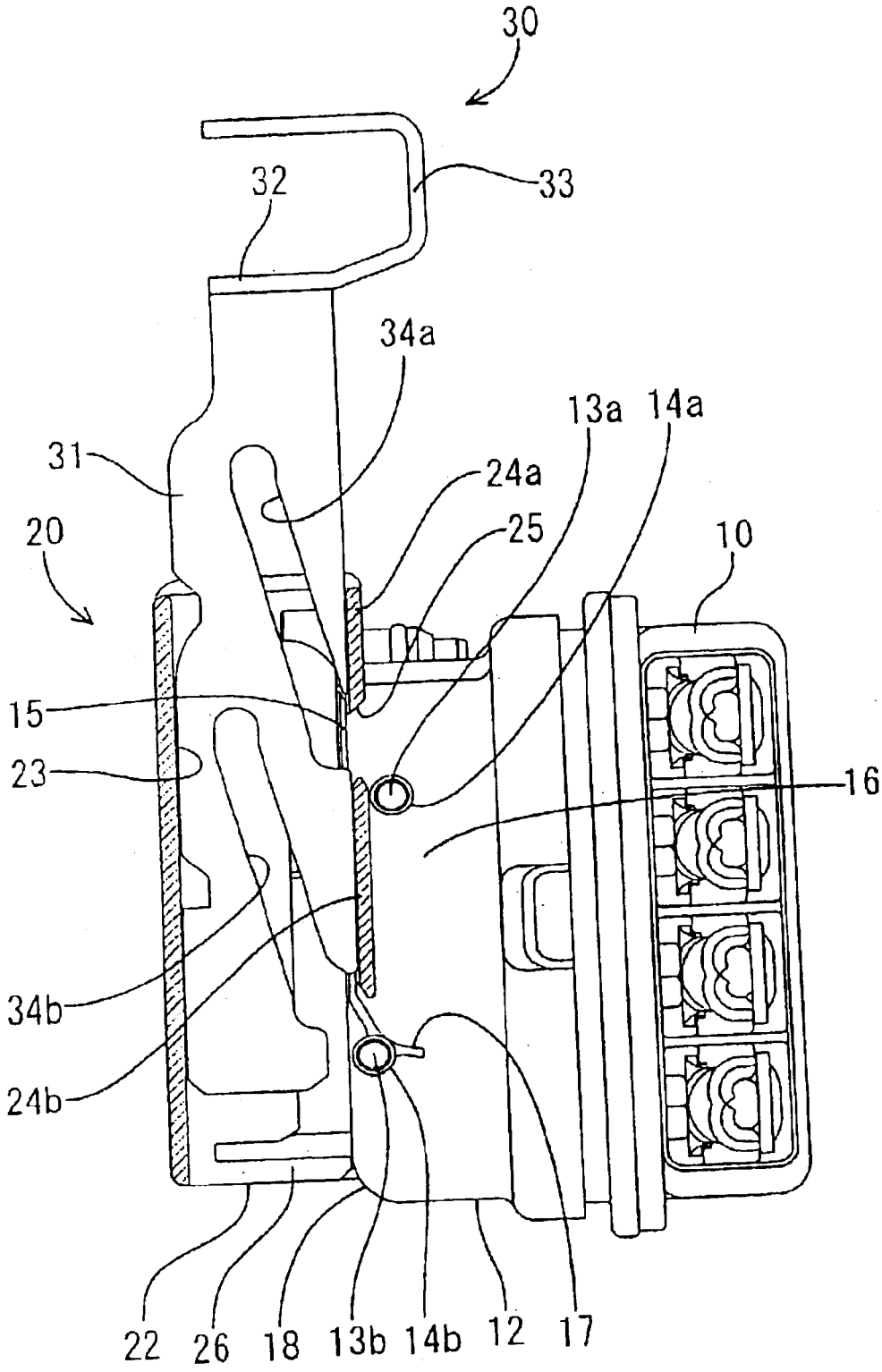
FIG. 2 is a partly cut away side view showing a state in which the movable-side housing has moved from an unmatching position to a position before a matching position.
Figure 3:
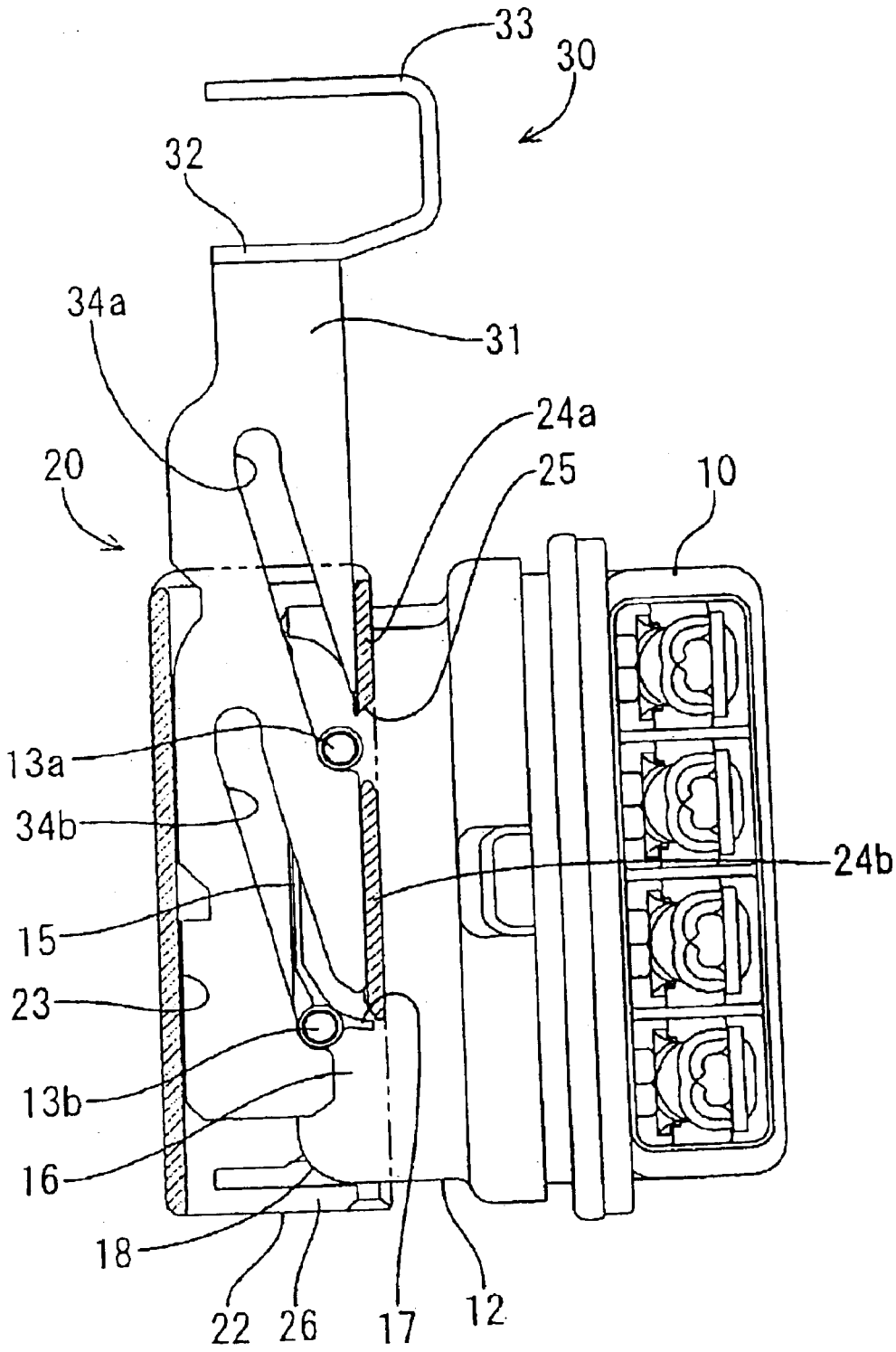
FIG. 3 is a partly cut away side view showing a state in which the movable-side housing has reached the matching position, and an entrance of a cam groove has fitted onto a cam follower.
Figure 4:
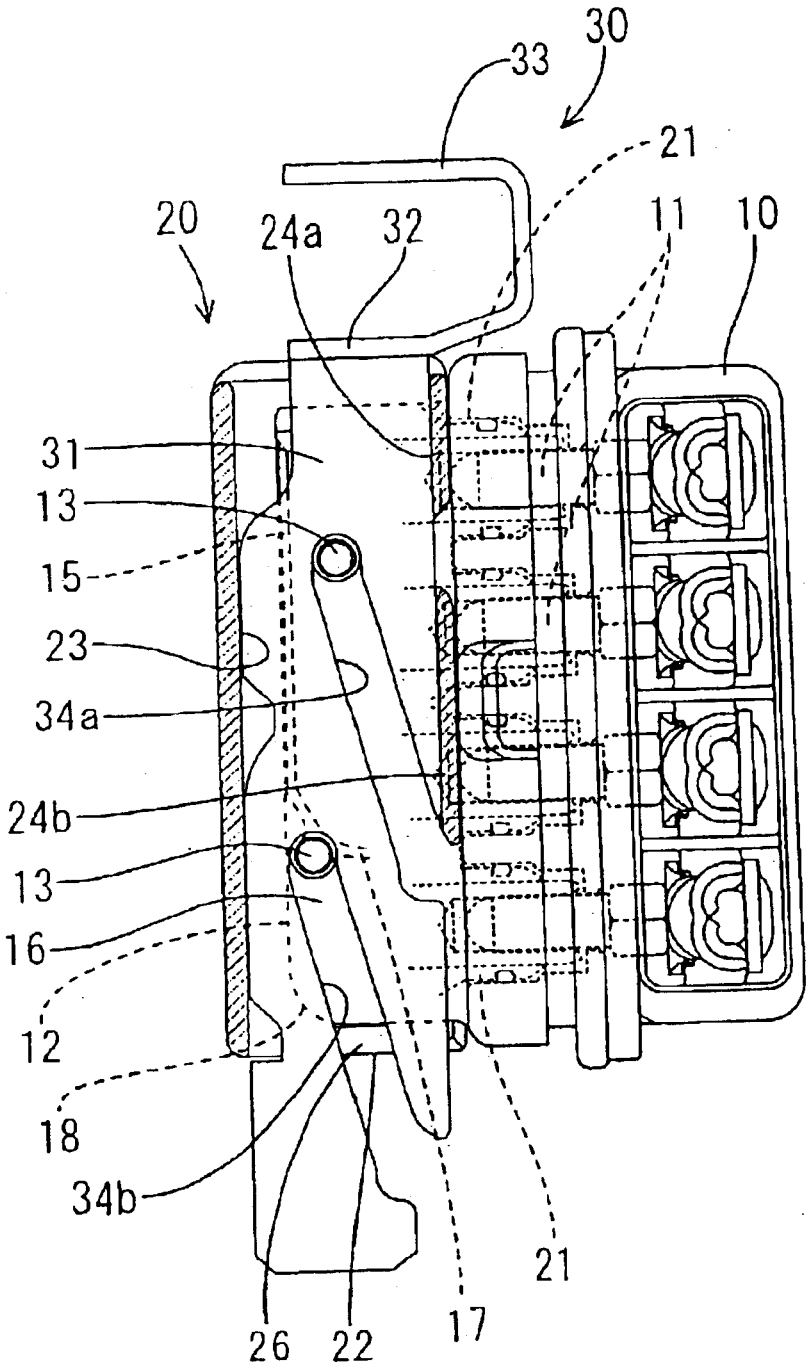
FIG. 4 is a partly cut away side view showing a state in which both housings have fitted on each other by moving a slide lever from an initial position to a fit-on position.

When the movable-side housing 20 moves further toward the matching position, as shown in FIG. 2, the lower portions 24*b* slidably contact the leading ribs 17, and the front end of the lower-surface wall 26 of the fit-on portion 22 slidably contacts the leading surface 18 of the hood part 12. At this time, the contact direction (obliquely down to the left, in FIG. 2) in which the lower portions 24*b* contact the leading ribs 17 is opposite to the contact direction (obliquely up to the right) in which the lower-surface wall 26 contacts the leading surface 18. Thus, the movable-side housing 20 is restricted from greatly loosening vertically or in the longitudinal direction with respect to the stationary-side housing 10, and from inclining forward or rearward.

Owing to the sliding contact between the leading ribs 17 and the lower portions 24*b* and the sliding contact between the leading surface 18 and the lower-surface wall 26, the moving direction of the movable-side housing 20 is altered from a straight-down direction to a direction that is obliquely downward to the right in FIG. 2. Thus, as the movable-side housing 20 moves downward, it approaches the stationary-side housing 10. Owing to the approaching operation, the entrances of the cam grooves 34*a* and 34*b* approach the cam followers 13*a* and 13*b*, respectively. Simultaneously with arrival of the movable-side housing 20 at the matching position, the cam followers 13*a* and 13*b* fit in the entrances of the cam groove 34*a* and that of the cam groove 34*b*, respectively (see FIG. 3). The front end of the hood part 12 fits shallowly in the fit-on portion 22 in this state. Therefore, the movable-side housing 20 is restricted from moving in the vertical direction (up-down direction in FIG. 3) and in a lateral direction (a direction orthogonal to the plane of the paper in FIG. 3) with respect to the stationary-side housing 10.

When the slide lever 30 at the initial position is pressed downward, the movable-side housing 20 is caused to approach the stationary-side housing 10 owing to the cam operation caused by the engagement between the cam grooves 34*a* and the cam followers 13*a* and between the cam grooves 34*b* and the cam followers 13*b*. When the pressing-down of the slide lever 30 is completed and when the cam followers 13*a* and 13*b* arrive at the inward end (upper end) of the cam grooves 34*a* and 34*b*, respectively, the movable-side housing 20 fits on the stationary-side housing 10 completely (see FIG. 4). Thus, the movable electrodes 21 are connected to the stationary electrodes 11.

As is apparent from the foregoing description, in the above-described embodiment, in the initial operation of fitting the movable-side housing 20 on the stationary-side housing 10, the entrances of the cam grooves 34*a* and 34*b* are not placed in position for the cam followers 13*a* and 13*b*, but the front lower end of the fit-on portion 22 is merely brought into contact with the front upper end of the hood part 12. Thereafter, the movable-side housing 20 is guided by the guide ribs 15, 24*a*, and 24*b* until the entrances of the cam grooves 34*a* and 34*b* and the cam followers 13*a* and 13*b* are correspondent to each other. Therefore, even in a situation in which it is difficult to visually check the position of the housing and hence it is necessary to perform a positioning operation gropingly, the movable-side housing 20 can be fitted on the stationary-side housing 10 easily and reliably.

In the above-described embodiment, in the stage in which the movable-side housing 20 moves from a position slightly before the matching position to the matching position, the moving direction of the movable-side housing 20 is altered to the oblique direction by the guidance of the leading ribs 17 and the leading surface 18. As this movement progresses, the cam followers 13*a* and 13*b* fit into the entrances of the cam groove 34*a* and the cam groove 34*b* respectively. That is, it is possible to accomplish the operation of moving the movable-side housing 20 to the matching position and the operation of fitting the cam followers 13*a* and 13*b* on the entrance of the cam groove 34*a* and that of the cam groove 34*b*, respectively, by a single action, e.g., the single action of pushing the movable-side housing 20 in one direction with respect to the stationary-side housing 10.

In the above-described embodiment, in changing the moving direction of the movable-side housing 20 by the guidance of the leading ribs 17 and the leading surface 18, the movable-side housing 20 is guided at upper and lower positions. Thus, the movable-side housing 20 is kept in a predetermined posture. Thereby, the cam followers 13*a* and

13*b* are capable of reliably fitting into the entrances of the cam grooves 34*a* and 34*b* respectively.

In the above-described embodiment, the direction of the movable-side housing as it moves from the unmatching position to the matching position is the same (downward) as the direction of the slide lever that moves thereafter from the initial position to the fit-on position. Hence, high operability can be obtained. There is little chance that the movable-side housing 20 at the matching position will return to the unmatching position when the slide lever 30 is operated.

The present invention is not limited to the embodiment described above with reference to the drawings. For example, the following embodiments are included in the scope of the present invention. Further, various other modifications can be made without departing from the spirit and scope of the present invention.

(1) In the above-described embodiment, as a structure for bringing the front leading end of the movable-side housing into the front base portion of the stationary-side housing, the guide of the fit-on portion is set to exist in a region excluding the leading end portion of the fit-on portion. However, according to the present invention, the range of the guide in the stationary-side housing may be set to exist in a region excluding the base portion of the fit-on portion.

(2) In the above-described embodiment, the direction of the movable-side housing as it moves from the unmatching position to the matching position is the same as the direction of the slide lever as it moves from the initial position to the fit-on position. However, the direction of the movable-side housing as it moves from the unmatching position to the matching position may be different from the direction of the slide lever as it moves from the initial position to the fit-on position.

What is claimed is:

1. A connector apparatus comprising:

a first housing having at least one cam follower;

at least one first electrode provided in said first housing;

a second housing including a fit-on portion that covers a portion of said first housing when the second housing is mated with said first housing;

at least one second electrode provided in said second housing;

a slide lever capable of moving linearly between an initial position and a fit-on position in a direction substantially orthogonal to a direction in which said second housing fits on said first housing, the slide lever including at least one cam groove, wherein said at least one first electrode and said at least one second electrode are connected to each other, with said fit-on portion being fitted on said first housing owing to a cam operation performed by cooperation of said at least one cam groove and said at least one cam follower, by moving said slide lever to the fit-on position;

at least one first guide provided on an outer side surface of said first housing; and at least one second guide provide on an inner side surface of said fit-on portion, wherein the at least one first guide and the at least one second guide do not engage each other at an unmatching position of said second housing in which a front leading end portion of said second housing contacts a front base portion of said first housing and at a matching position in which an entrance of said at least one cam groove matches with said at least one cam follower, and the at least one first guide and the at least one second guide engage each other during movement of said second housing from said unmatching position to said matching position to thereby guide said second housing.

2. A connector apparatus according to claim 1, wherein said at least one first guide includes a leading portion that guides said at least one cam follower into said entrance of said at least one cam groove and guides said second housing in an oblique direction with respect to the direction of movement of said slide lever during a movement of said second housing from a position before said matching position to said matching position.

3. A connector apparatus according to claim 2, further comprising a leading surface formed on a front edge of a lower end of the first housing, wherein the leading surface assists the leading portion in guiding said second housing in an oblique direction with respect to the direction of movement of said slide lever during the movement of said second housing from a position before said matching position to said matching position, the leading surface being provided at a position spaced from the leading portion in a direction in which said second housing moves between said unmatching position and said matching position.

4. A connector apparatus according to claim 1, wherein a direction of said second housing as said second housing moves from said unmatching position to said matching position is the same as a direction of said slide lever as said side lever moves from said initial position to said fit-on position.

5. A connector apparatus according to claim 1, wherein the connector apparatus is a breaker apparatus, and wherein:

the at least one first electrode comprises at least two first electrodes; and the at least one second electrode electrically connects the at least two first electrodes to each other when the slide lever is moved to the fit-on position.

* * * * *